US010179080B2

(12) United States Patent
Dollarhide

(10) Patent No.: US 10,179,080 B2
(45) Date of Patent: Jan. 15, 2019

(54) GUIDE DEVICE FOR AMBULATORY ASSIST DEVICE AND METHOD

(71) Applicant: Walker Buddezz Holdings, Inc., Nashville, TN (US)

(72) Inventor: Chad Dollarhide, Burbank, CA (US)

(73) Assignee: Walker Buddezz Holdings, Inc., Nashville, TN (US)

( * ) Notice: Subject to any disclaimer, the term of this patent is extended or adjusted under 35 U.S.C. 154(b) by 0 days.

(21) Appl. No.: 15/581,715

(22) Filed: Apr. 28, 2017

(65) Prior Publication Data

US 2017/0312164 A1 Nov. 2, 2017

Related U.S. Application Data

(60) Provisional application No. 62/329,878, filed on Apr. 29, 2016.

(51) Int. Cl.

| | |
|---|---|
| ***A61H 3/02*** | (2006.01) |
| ***A45B 9/04*** | (2006.01) |
| ***F21V 23/04*** | (2006.01) |
| ***F21V 33/00*** | (2006.01) |
| ***A45B 3/04*** | (2006.01) |
| ***A45B 3/08*** | (2006.01) |

(Continued)

(52) U.S. Cl.

CPC ..... *A61H 3/0288* (2013.01); *A45B 3/04* (2013.01); *A45B 3/08* (2013.01); *A45B 9/04* (2013.01); *A61H 3/0277* (2013.01); *F21V 23/0464* (2013.01); *F21V 23/0471* (2013.01); *F21V 33/0064* (2013.01); *A61H 3/04* (2013.01); *A61H 2201/0173* (2013.01); *A61H 2201/0188* (2013.01); *A61H 2201/0192* (2013.01); *A61H 2201/503* (2013.01); *A61H 2201/5025* (2013.01); *A61H 2201/5048* (2013.01); *A61H 2201/5061* (2013.01); *A61H 2201/5092* (2013.01); *F21Y 2115/10* (2016.08); *H04R 1/028* (2013.01)

(58) Field of Classification Search

CPC ..... A61H 3/0288; A45B 9/04
USPC ..... 135/77
See application file for complete search history.

(56) References Cited

U.S. PATENT DOCUMENTS 877,231 A * 1/1908 Rogers, Jr. ..... A61H 3/0288 135/86
2,453,742 A * 11/1948 Bowen ..... A61H 3/0288 135/77

(Continued)

FOREIGN PATENT DOCUMENTS

WO WO-03005852 A1 * 1/2003 ..... A45B 9/04

OTHER PUBLICATIONS

International Search Report, PCT/US2017/030137 (dated Jul. 13, 2017).
Written Opinion, PCT/US2017/030137 (dated Jul. 13, 2017).

*Primary Examiner* — Noah Chandler Hawk
(74) *Attorney, Agent, or Firm* — Baker Donelson

(57) ABSTRACT

A guide device providing a dimensional and ornamental guide that, engaging a leg of an ambulatory assist device used by a person, provides walking assistance, including a boot leg or sleeve for joining about a portion of the leg of the ambulatory assist device and receiving a resilient body axially for dimensional extents and receiving a guide member having a bottom glide surface for contact with a floor surface. A method of facilitating guidance of an ambulatory assist device is disclosed.

38 Claims, 12 Drawing Sheets

(51) Int. Cl.

| | |
|---|---|
| *H04R 1/02* | (2006.01) |
| *A61H 3/04* | (2006.01) |
| *F21Y 115/10* | (2016.01) |

(56) References Cited

U.S. PATENT DOCUMENTS

| | | | | |
|---|---|---|---|---|
| 3,376,880 | A * | 4/1968 | Stark | A45B 9/04 135/81 |
| 3,906,971 | A | 9/1975 | Burnstine | |
| 6,647,589 | B1 | 11/2003 | Youngwith | |
| 8,627,839 | B1 | 1/2014 | Martinez | |
| 9,090,126 | B1 | 7/2015 | Watcharasakunee | |
| 2008/0244870 | A1 | 10/2008 | Chase | |
| 2009/0078296 | A1 | 3/2009 | Diamond | |
| 2009/0308420 | A1 | 12/2009 | Galanty | |
| 2012/0085378 | A1 | 1/2012 | Chakraborty | |

* cited by examiner

GUIDE DEVICE FOR AMBULATORY ASSIST DEVICE AND METHOD

The present application claims benefit of U.S. Provisional Patent No. 62/329,878 filed Apr. 29, 2016.

TECHNICAL FIELD

The present invention relates to ambulatory assist devices and methods. More particularly, the present invention relates to a guide disposed on a leg of an ambulatory assist device for facilitating walking by a person using the ambulatory assist device.

BACKGROUND OF THE INVENTION

Older individuals, and some younger persons as well, may experience difficulty in walking and maintaining balance while walking. This may occur as muscles and joints tighten in older individuals, or may result from injury or surgery. Walking for such persons becomes a problem, and stepping actions of raising and lower of feet sometimes becomes a shuffling movement during walking. Such persons are benefited physically and mentally by continuing involved activity with others and with walking as required for movement between bed and bath, dining rooms, and outside activities. Persons may assist, such as by holding arms as a support on which to lean.

Physical equipment providers have addressed the need for support apparatus to assist with individuals who experience difficulties with walking and standing. The ambulatory assist devices include motorized movement vehicles, canes, and four-legged walking devices that are commonly referenced as "walkers". The four-legged walking devices include handles for gripping and front and back legs extend from the handles to the ground for support. Often the distal ends have caps on the ends that contact the ground. The front legs in some embodiments include wheels or rollers, for facilitating the walking of the user.

While such walker ambulatory assist devices assist with the walking actions of the person, there are drawbacks. Persons with problems of walking and balance may move into walls and furniture while walking even with use of an ambulatory assist device. The wheels may make the ambulatory assist device move more quickly than the person being supported may be capable. Caps made of rubber may be relatively stopped by certain types of floor surfaces, and the person being assisted may stumble relative to the ambulatory assist device.

Accordingly, there is a need in the art for an improved guide device attachable to a leg of an ambulatory assist device and method to facilitate walking use of the ambulatory assist device by a person. It is to such that the present invention is directed.

BRIEF SUMMARY OF THE INVENTION

The present invention meets the need in the art by providing a guide device for an ambulatory assist device, comprising a sleeve comprising a first shell and a second shell for disposing on a lower end of a leg of an ambulatory assist device with a body having a through passageway defining opposing open ends and means for detachably engaging the first shell and the second shell together about the leg of the ambulatory assist device; the passageway disposed on a first axis of the body for enclosingly receiving the sleeve in the passageway, the body having an exterior surface that defines a dimensional extent beyond a plane defined by an exterior surface of the leg. A glide member having a continuous side wall for defining a chamber that is open at one end and closed by a bottom surface at an opposing end, wherein the chamber in the glide member receives a lower portion of the sleeve with the side wall received into the passageway of the body. The dimensional extent of the body defines a contact surface for guiding a user while walking with the ambulatory assist device past obstructions to passage.

In another aspect, the present invention provides a guide for an ambulatory assist device, comprising a sleeve having a first portion and a second portion for disposing on a leg of an ambulatory assist device, the first portion having a first cross-sectional area and the second portion having a second cross-sectional area different from the first cross-sectional area, and a body having a through passageway defining opposing open ends, the passageway disposed on a first axis of the body and having a first section that receives the first portion of the sleeve and a second section that receives the second portion of the sleeve for enclosingly receiving the sleeve in the passageway, the body having an exterior surface that defines a dimensional extent beyond a plane defined by an exterior surface of the leg. A glide member having a continuous side wall for defining a chamber that is open at one end and closed by a bottom surface at an opposing end, wherein the chamber in the glide member receives a lower portion of the sleeve with the side wall received into the passageway of the body and whereby the dimensional extent of the body defines a contact surface for guiding a user while walking with the ambulatory assist device past obstructions to passage.

In another aspect, the present invention provides a guide for an ambulatory assist device, comprising a sleeve for disposing on a leg of an ambulatory assist device and a body having a through passageway defining opposing open ends, the passageway disposed on a first axis of the body for enclosingly receiving the sleeve in the passageway, the body having an exterior surface that defines a dimensional extent beyond a plane defined by an exterior surface of the leg. The exterior surface of the body includes an ornamental feature. A glide member having a continuous side wall for defining a chamber that is open at one end and closed by a bottom surface at an opposing end, wherein the chamber in the glide member receives a lower portion of the sleeve with the side wall received into the passageway of the body and whereby the dimensional extent of the body defines a contact surface for guiding a user while walking with the ambulatory assist device past obstructions to passage.

In another aspect, the present invention provides a guide for an ambulatory assist device, comprising a sleeve for disposing on a leg of an ambulatory assist device and a body having a through passageway defining opposing open ends, the passageway disposed on a first axis of the body for enclosingly receiving the sleeve in the passageway, the body having an exterior surface that defines a dimensional extent beyond a plane defined by an exterior surface of the leg. A cover having an ornamental feature selectively detachably attaches to the body. A glide member having a continuous side wall for defining a chamber that is open at one end and closed by a bottom surface at an opposing end, wherein the chamber in the glide member receives a lower portion of the sleeve with the side wall received into the passageway of the body and whereby the dimensional extent of the body defines a contact surface for guiding a user while walking with the ambulatory assist device past obstructions to passage.

In another aspect, the present invention provides a guide for an ambulatory assist device, comprising a sleeve for disposing on a leg of an ambulatory assist device and a body having a through passageway defining opposing open ends, the passageway disposed on a first axis of the body for enclosingly receiving the sleeve in the passageway, the body having an exterior surface that defines a dimensional extent beyond a plane defined by an exterior surface of the leg. The body has a pocket defined by closed edges and an open edge, the pocket having a transparent cover disposed between the closed edges thereof, whereby an ornamental sheet may be positioned through the open edge in the pocket. A glide member having a continuous side wall for defining a chamber that is open at one end and closed by a bottom surface at an opposing end, wherein the chamber in the glide member receives a lower portion of the sleeve with the side wall received into the passageway of the body and whereby the dimensional extent of the body defines a contact surface for guiding a user while walking with the ambulatory assist device past obstructions to passage.

In another aspect, the present invention provides a method of facilitating guidance during use of an ambulatory device, comprising the steps of:

(a) disposing a sleeve on a lower portion of a leg of an ambulatory assist device, comprising the steps of:

(i) positioning a longitudinally extended first shell onto the leg of the ambulatory assist device; and (ii) attaching a longitudinally extended second shell onto the leg of the ambulatory assist device, (b) positioning a body on the sleeve, the body having a through passageway defining opposing open ends for enclosingly receiving the sleeve in the passageway, the body having an exterior surface that defines a dimensional extent beyond a plane defined by an exterior surface of the leg; and (c) closing a lower end of the through passageway with a glide member having a continuous side wall that defines a well open at a first end for receiving a portion of the sleeve upon inserting the glide member into the passageway and closed at an opposing end with a bottom glide surface for contacting a surface during use by a person walking with aid of the ambulatory assist device, whereby the dimensional extent of the body defines a contact surface for guiding the user walking past obstructions to passage.

Objects, advantages, and features of the present invention will become readily apparent upon a reading of the following detailed description of the guide device in accordance with the present invention, in conjunction with the drawings and the appended claims.

DETAILED DESCRIPTION

Figure 1:
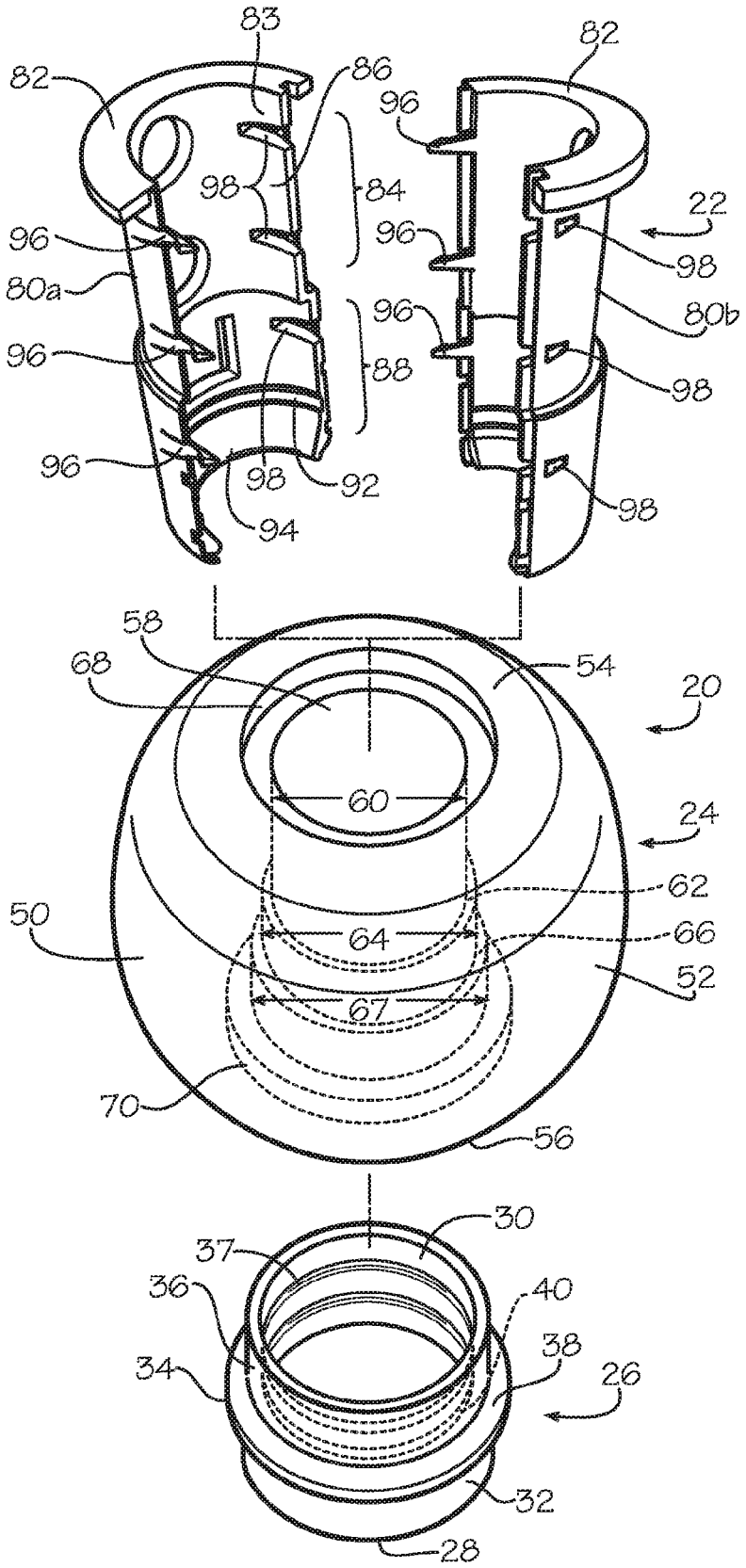
FIG. 1 illustrates in perspective exploded view a guide device in accordance with the present invention for engaging a leg of an ambulatory assist device.

Broadly, the present disclosure relates to devices configured to fit over a lower end of an ambulatory assist device (e.g. crutch, walker, cane) and provide a surface configured to promote gliding engagement over a variety of different surfaces (e.g. grass, concrete, tile, hardwood). More specifically, the present disclosure relates to devices configured to fit over a lower end of an ambulatory device and enable a user to interchange a number of decorative covers over an outer surface of a resilient body of the ambulatory assist device to configure the ambulatory assist device to the aesthetics of the user, while providing for a gliding engagement with a variety of surfaces. In some embodiments, the ambulatory assist device is configured to fit onto an ambulatory equipment (e.g. four wheeled walker, wheelchair) and/or other personal assist device (e.g. extended height commode chair, shower chair, and/or bed leg).

Various ones of the inventive aspects noted herein may be combined to yield devices configured to fit onto a lower end of an ambulatory device (e.g. walker, cane, crutches, and the like). Alternatively, the guide devices are configured to fit onto upper portions such as frame members of various ambulatory assist devices and/or ambulatory equipment.

As used herein, "ambulatory equipment" means a device that assists a user with walking. Some non-limiting examples of ambulatory equipment include: a walker, axillary crutch (one or two), a cane (e.g. one or four point); a forearm/Lufstancl crutch (e.g. forearm cuff); and/or a prosthetic device. In an alternative embodiment, the assist device is configured to a medical device and/or assist device. Some non-limiting examples of instances where the device is configured onto an assist device or medical device includes devices configured to move/assist the user with wheels (e.g. four-wheeled walker, wheel chair) and/or retain the user in place (e.g. commode chair, shower chair, bed).

As used herein, "ambulatory assist device" means: a device configured to fit onto a lower end of ambulatory equipment and provide a sliding engagement between the lower ends of the ambulatory equipment to assist the user in walking/moving. In one aspect, an ambulatory assistance device is provided which includes: a boot leg or sleeve, a glide member, and a liner or resilient body, and in an alternate embodiment, a cover.

In some embodiments, the ambulatory assistance device is configured to assist the user in preventing movement (e.g. configured for frictional engagement). A non-limiting example of an ambulatory assistance device includes: a boot leg or sleeve, a frictional engagement member, and a liner or resilient body, and in an alternate embodiment, a cover. Some non-limiting examples of ambulatory assistance device that would be configured with at least one frictional engagement members include commode chairs, shower chairs, and/or beds (bed posts/legs).

In some embodiments, the ambulatory assist device is configured to fit onto a four-wheeled walker and/or wheelchair (such that the medical assist device extends out of both ends of the ambulatory assist device) to provide an aesthetic element and/or a locating device (e.g. when configured with LED, auditory, and/or glow-in-the-dark component. A non-limiting example of an assist device includes: a boot leg or sleeve, and a liner or resilient body, and in an alternate embodiment, a cover.

In one or more embodiments of the instant disclosure, an ambulatory assist device is configured to fit onto (over) a peg leg (and/or end caps) of ambulatory equipment. For example, with ambulatory equipment, the glide is configured to promote sliding engagement of the ambulatory equipment (i.e. materials configured to reduce, prevent, and/or eliminate frictional engagement of glide bottom with surface (i.e. decrease static and/or kinetic friction between the device/glide and the surface).

As used herein, "ambulatory assist device" means a device configured to fit onto the bottom (e.g. peg leg) of ambulatory equipment, where the lower end of the device (e.g. glide) is configured to promote a sliding engagement with various surfaces and textures. In some embodiments, the device is configured to fit onto the peg leg portion of the ambulatory equipment and provide a glide support configured to slide over a number of surfaces (concrete, dirt, grass, carpet, smooth indoor flooring, and the like). In some embodiments, the ambulatory assist device includes: a boot leg or sleeve, a glide member, and a resilient body having an aesthetic component (e.g. ornamentation on the liner surface of the resilient body and/or a cover). In some embodiments the ambulatory assist device is configured with an 0-ring (e.g. configured between the inner wall of the boot leg or sleeve and the outer wall of the peg leg (e.g. lower portion of the ambulatory equipment).

As used herein, "boot leg" or "sleeve" means a covering configured to fit over a lower portion of a piece or component of ambulatory equipment (e.g., a peg leg). In some embodiments, the boot leg or sleeve is integral (i.e. one piece sleeve). In some embodiments, the boot leg comprises a multi-component configuration. As a non-limiting example, the illustrated embodiment discloses a two-piece assembly of shells configured for mating attachment, for example, with mechanical engagement components configured on each of the two pieces. As non-limiting examples, the boot leg or sleeve is made of: polymers and/or plastics, including polypropylene, polyethylene, polystyrene, polypropylene and combinations thereof.

In some embodiments, the boot leg or sleeve is configured with an inner sidewall having grooves and/or ridges to promote attachment to a lower peg leg having various dimensions (e.g. different sized caps provided with the ambulatory equipment or coming with the unit and/or different configurations of the peg leg).

As used herein, "glide member" means an end cap configured to fit onto the boot leg or sleeve and/or the lower end of the ambulatory equipment (i.e. peg leg). In some embodiments, the glide member is configured from a material with a low coefficient of kinetic and static friction. As non-limiting examples, the glide member is configured from: nylon plastics, nylon, plastic, polymers, or combinations thereof.

In some embodiments, the glide member is configured to be pressed onto the distal part of the boot leg or sleeve and a lower portion of the peg leg, such that the glide member is retained via interference fit (e.g. frictional engagement). In some embodiments, the inner sidewall of the glide member is configured with raised tabs and/or ridges to provide a press-lock mechanism to lock the peg leg and boot leg or sleeve into the glide member. In some embodiments, the glide member is a circular platform-based glide device, with a bottom portion configured larger than the base of the peg leg (bottom portion), such that the glide member is configured to fit around/over the end of the peg leg (i.e., while the peg leg is covered in the boot leg or sleeve). As non-limiting examples, the glide member can be configured from various materials, including: durable plastics, nylons, and other low friction materials.

In some embodiments, the glide member is configured to promote a smooth and continuous movement of the ambulatory assist device along a surface (i.e., with little effort from the user and little resistance from friction between the glide (i.e. glide bottom surface) and the floor surface.

As used herein, "frictional engagement member" means an end cap configured to fit onto the boot leg and/or lower end of the ambulatory equipment (i.e. peg leg). As a non-limiting example, the frictional engagement member is configured from a material with a high coefficient of static and/or kinetic friction. As non-limiting examples, the frictional engagement member is configured from: rubber, plastic, polymers, or combinations thereof.

As used herein, "body" means the component configured to fit onto the boot leg or sleeve and/or the glide member. In some embodiments, the body includes an integral liner and detachable selectively attached cover, which provide dimensions to an aesthetic element (e.g. decorative component) configured on the outer surface of the body or alternatively, on the cover. In some embodiments, the liner is separate from the cover.

As used herein, "liner" means an object used to line or back something. In some embodiments, the liner is configured to provide dimensional characteristics (e.g. spherical, oblong, or other geometric configuration) to the boot leg or sleeve and peg leg, i.e., such that the cover can be placed on the liner and provide support to the aesthetic component of the cover. As non-limiting examples, the liner can be configured from: a super low density foam, a low density foam, a moderate density foam, a firm density foam, a high firm density foam, plastic(s), polymer(s), rubber(s), and combinations thereof.

In either embodiment (i.e. whether a resilient body with integral liner and cover or a separate liner and cover), these components are configured to fit onto the boot leg or sleeve and the glide member, and be retained in position while the ambulatory equipment is in use. More specifically, the liner is configured to slide onto the boot leg or sleeve and over the parametrical sidewall of the glide member, such that the liner is retained in position below a collar or flange of the boot leg or sleeve and above a collar or flange of the glide member.

As used herein, "cover" means an object configured to lie on, over, or around the liner (or resilient body received on the boot leg or sleeve). In some embodiments, the cover is configured to fit onto the boot leg and glide member in the same manner as the liner, wherein the cover is retained over the liner As non-limiting examples, the cover is configured from: plush materials, cloths, felts, nylon, vinyl, VELCRO, glass, rubbers, acrylics, plastics, fabrics, cotton threads, glow-in-the-dark/phosphorescent materials, wood, aluminum, metals (e.g. gold, silver, copper and the like), and combinations thereof. In some embodiments, one or more of the aforementioned materials are combined to create the likeness and form of one or more of the aesthetic components/decorative elements configured into and/or onto the cover.

In some embodiments, at least one of the cover and the resilient body are configured with an aesthetic component (e.g. decorative element). As non-limiting examples, the aesthetic component can be configured as seasonal components, religious themes, sports and/or licensed sports teams, animals, characters (including licensed TV, internet, and/or movie characters), and/or combinations thereof. As some additional examples, identifying shapes and characteristics of an assortment of objects and characters; animal faces and bodies (teddy bears, cats, dogs, etc.), holiday or seasonal themed characters (Santa Claus, elves, snow man, Jack o'lanterns, Easter bunny, faces, etc.), squirrel heads in football helmets, cartoon characters, super hero characters, and the like.

In some embodiments, at least one of the cover and/or liner are configured with at least one photograph element, configured as a photo frame and/or sleeve configuration. In this embodiment, the at least one photo can be displayed on the liner and/or cover of the ambulatory assistance device (or assist device, when used without the glide and/or frictional component).

In some embodiments, the cover is configured with a backing, transparent sleeve, and perimetrical frame configured to attach the transparent sleeve to the backing such that a photograph can be displayed and/or adjusted/replaced with a different photograph. In some embodiments, the photograph element is: a 1"×1" photo, a 2"×2" photo, or a 2"×3" photo.

In some embodiments, the aesthetic component comprises a decorative casing.

In some embodiments the cover is configured with illuminating components (e.g. LED lights). In some embodiments, the LED lights are configured into the body (e.g. liner and/or cover), such that the battery and wire system are retained out of sight and the LED lights are configured on the cover (e.g. as part of the aesthetic component).

In some embodiments, the cover is configured with glow-in-the-dark portions, such that the user can easily find the ambulatory equipment at night and/or in a dark location. In some embodiments, the glow-in-the-dark portion(s) are configured from phosphorescent paint and/or materials woven throughout the cover and/or liner such that the device glows in dimly lit and/or dark areas. In some embodiments, the glow-in-the-dark portion(s) are configured as a safety feature to the user.

In some embodiments, the glow-in-the-dark or phosphorescent materials are integrated into at least one of: the boot leg or sleeve, the glide member, and the body (e.g. liner and/or cover). In some embodiments, the glow-in-the-dark or phosphorescent materials are integrated into all of: the boot leg, glide, and body (e.g. liner and/or cover).

In some embodiments, the glow-in-the-dark component comprises: phosphorescent threads, vinyls, plastics, paints, and combinations thereof.

In some embodiments, the cover (and/or liner) is configured with an audio component configured to record and/or store and play back prerecorded messages or songs. In some embodiments, the audio device comprises a pressure activated speaker device that will be hidden in the body (e.g. liner and/or cover) of the device. In this embodiment, the audio device is configured with memory, power (e.g. battery-powered) and audio speakers, such that the device is capable of storing pre-recorded messages, theme songs, animal sounds, gait or ambulatory instruction and play back of the audio portion when the walker is in use or in a stopped position.

In some embodiments, the audio device is configured with a speaker positioned closer to the user, with a wire connecting the device to the speaker (i.e. whether the speaker is retained on the frame and/or adjacent to the handles of the ambulatory equipment). In this embodiment, the wire and/or speaker are configured to be secured to the frame with mechanical devices (e.g. plastic clips, tie wraps, elastic cords, or the like).

In some embodiments, the audio device is configured in (e.g. implanted within) the body (e.g. cover and/or liner) of the device and equipped with a press to activate/squeeze to activate button. In some embodiments, the audio device is configured/integrated into the glide boot with pressure sensors (pressure activated feature) such that when weight is applied to the peg legs of the walker through standing up, pressure activates the audio device and the audio components play for the user.

In some embodiments, a kit is provided, which includes a boot leg or sleeve, at least one glide member, and multiple interchangeable bodies (e.g., liner and/or cover). In this embodiment, the user can remove and replace the resilient body (e.g. liner and/or cover) with different aesthetic components as the user desires.

With reference to the drawings, in which like parts have like reference numerals, FIG. 1 illustrates in perspective exploded view a guide device 20 in accordance with the present invention for engaging a leg of an ambulatory assist device. The guide device 20 comprises a boot leg or sleeve 22 for joining about a portion of a leg of an ambulatory assist device (not depicted in FIG. 1). A resilient body 24 axially mounts to the sleeve 22 and receives a guide member 26 having a bottom glide surface 28. In the illustrated embodiment, the body 24 is a unitary foam material molded member that incorporates a shape-defining body and a resilient layer material as a liner rather than such body in an alternate embodiment being two separate members—a shaped body and a liner that join together to define the body 24.

The guide member 26 in the illustrated embodiment is a cylindrical member. The guide member 26 has an open end 30 and an opposing closed bottom 32. The bottom 32 defines the outside bottom glide surface 28 for gliding contact with a surface, such as a floor, walkway, yard or the like, during use an ambulatory assist device 20, as discussed below. The guide member 26 defines an inner well 37 closed by the bottom 32. A flange 34, or collar, extends radially from an outer surface of the guide member 26 intermediate the open end 30 and the bottom surface 28. The flange 34 preferably is proximate and spaced-from the bottom 26 and thereby is relatively remote from the open end 30 to define a perimetrical wall 36 extending in a direction, preferably perpendicularly, therefrom. The perimetrical wall 36 defines the cup-shaped configuration of the guide member 26 that fits onto the lower end of the sleeve 22 and the peg leg of the ambulatory equipment. An upper surface of the flange 34 defines a seat 38. The inner wall of the guide member 26 defines a groove 40 proximate and spaced from the bottom 26, for a purpose discussed below.

The resilient body 24 in the illustrated embodiment comprises a member 50 having an exterior surface 52 and opposing upper and lower planar surfaces 54, 56. The exterior surface 52 of the body 24 accordingly defines a dimensional extent for a obstructions contact surface as discussed below. The surface 52 tapers arcuately from an equatorial portion to the edges of the opposing planar surfaces 54, 56. The body 24 defines a axial passageway 58 open in the opposing planar surfaces 54. 56. In the illustrated embodiment, the passageway 58 has a first diameter 60 in a portion from the upper surface 54 to a first transition 62, a second diameter 64 therefrom to a second transition 66, and a third diameter 67 therefrom to the opposing lower planar surface 56. The upper surface 54 defines a first annular recess 68. The lower surface 56 defines a second annular recess 70.

The resilient body 24 in the illustrated embodiment comprises a foam material molded to define the dimensional extents of the exterior surface 52 and passageway 58. The body 24 thereby incorporates the liner as a unitary member. An alternate embodiment provides a body member to which the liner attaches, such as with adhesive, bonding or overlayment, to define the exterior surface. The liner preferably comprises a resilient material. The exterior surface 52 may gainfully include an ornamental design, text or graphic, such as a sports image, name or the like. In alternate embodiment, the resilient body 24 assembles from opposing hemispheric members that attach together about the sleeve 22, for example, the hemispheric members define aligned opposing passages that receive a pin for mechanically connecting the members together to define the body 24. Alternatively, the hemispheric members adhesively attach together about the sleeve 22.

The sleeve 22 in the illustrated embodiment comprises a pair of opposing matingly engagable shells 80*a*, 80*b*. The shells 80*a*, 80*b* are longitudinally extended semi-circular mirror-image members. A flange 82 extends outwardly radially from a first end 83. The shell 80 defines in a first portion 84 an inner wall of a first radius and a second portion 88 of a second radius. The first radius is less than the second radius. The transition between the first and second radius corresponds with the first transition 62 of the passageway 58. The length of the first portion 84 thereby is the same as the length of the passageway 58 from the recess 68 to the first transition 62 for seating the shell 80 within the passageway 58 with a surface thereof contacting the shell. The second portion 88 defines an accurate groove 92 inwardly of an end of the shell 80. A flange 94 having a tapering surface extends radially from the inner wall towards a longitudinal axis of the shell 80. This defines a semi-circular open end of the shell 80.

The mirror image shells 80 matingly engage to define the circular sleeve 22. In the illustrated embodiment, the shells 80 have opposing longitudinal edges. A first edge defines a first mating member of a first characteristic and the opposing second edge defines a second mating member of a second characteristic. The first and second characteristics enable the separate detached shells 80 to detachably engage selectively together. In the illustrated embodiment, the shells 80 are equipped with mechanical engagements of the first and second mating members, configured to connect together such that the shell 80*a* as first piece and shell 80*b* as a second piece attach together to form the shell 22 or boot leg received on the leg of the ambulatory equipment. In the illustrated embodiment, the mechanical engagements comprise at least two spaced-apart fingers 96 defined on the first edge and the at least two spaced-apart slots 98 defined proximate the second edge. Three spaced-apart fingers and slots are illustrated. The fingers 96 extend as tangs from the inner wall. The spacing of the fingers 96 and slots 98 are the same, so that the fingers 96 of the shell 80*a* align with the slots 98 of the opposing shell 80*b*, for mechanically detachably engaging the shells as a sleeve or boot leg around a leg of an ambulatory assist device, as discussed below.

Figure 1A:
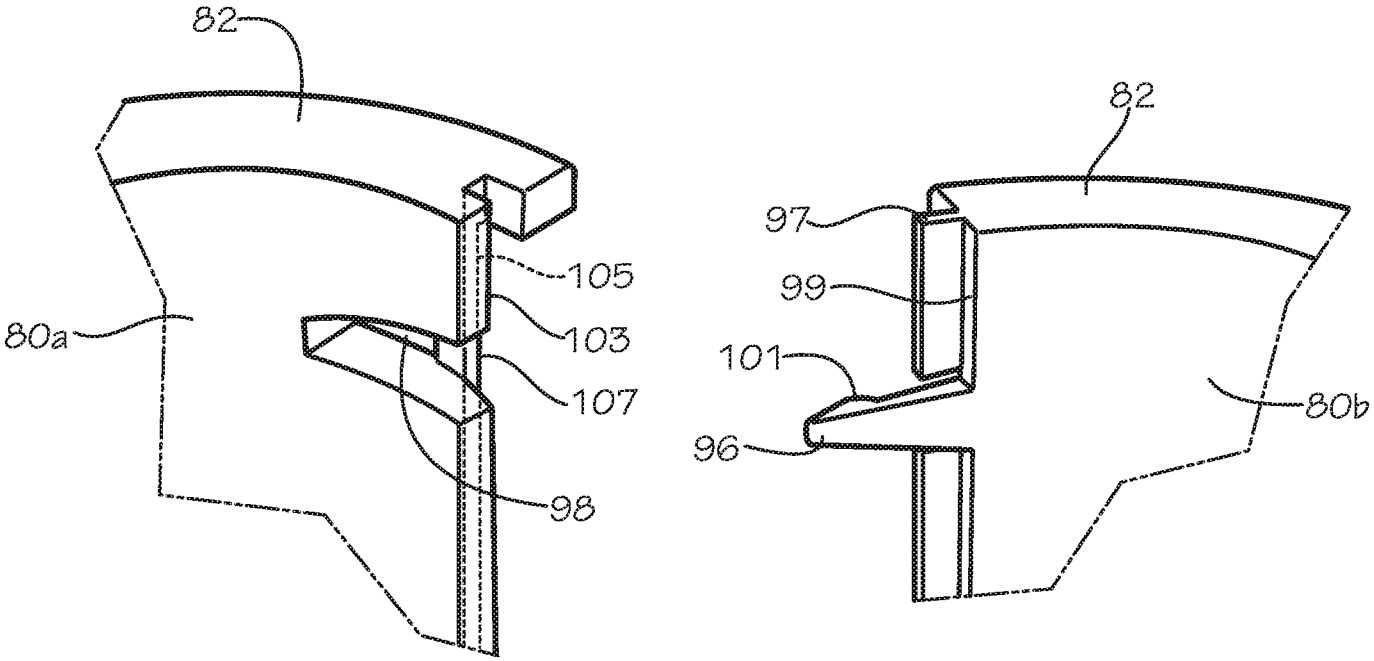
FIG. 1A illustrates in detailed perspective view features of the mechanical engagements of the shells that connect together to form the sleeve for the guide device illustrated in FIG. 1.

FIG. 1A illustrates in detailed perspective view one of the fingers 96 of the shell 80*b*. A first one of the longitudinal edges of the shells 80 includes a longitudinal tongue 97 extending therefrom spaced outwardly from the inner surface of the wall to define a step 99. The finger 96 extends laterally relative to a gap in the tongue 97. A distal end of the finger 96 defines a projection 101 on the side of the finger. The second longitudinal edge of the shell 80*a* defines a projecting distal portion 103 with a recessed seat 105 laterally thereof for receiving the tongue 97 as a tongue-and-groove connection when the shells 80*a*, 80*b* join together. The slot 98 aligns with the finger 96. A stop 107 extends in the wall across the slot 98. The projection 101 enters the opening of the slot 98 and contacts the stop 107 to hold the finger 96 in the slot 98.

In the illustrated embodiment, the first portion 84 defines a pair of spaced-apart openings 100. The openings 100 correspond to conventional height adjustment openings typically spaced-apart in the wall of the leg of the ambulatory assist device to which the guide device 20 attaches. The openings 100 enable a spring-biased pin in the leg to project outwardly of the leg into the opening. The pin in the leg extends through a respective opening in the leg for selectively positioning a telescoping member of the leg for adjusting the height of the ambulatory assist device for the particular person, while the guide device 20 is positioned on the leg of an ambulatory equipment. In yet another alternate embodiment (not illustrated), the shells of the sleeve have abutting opposing edges and a band received around an exterior holds the shells together. The band may be elastic, have an adhesive surface for attaching to the shells, or connectors on opposing ends for securing the band around the shells.

Figure 2:
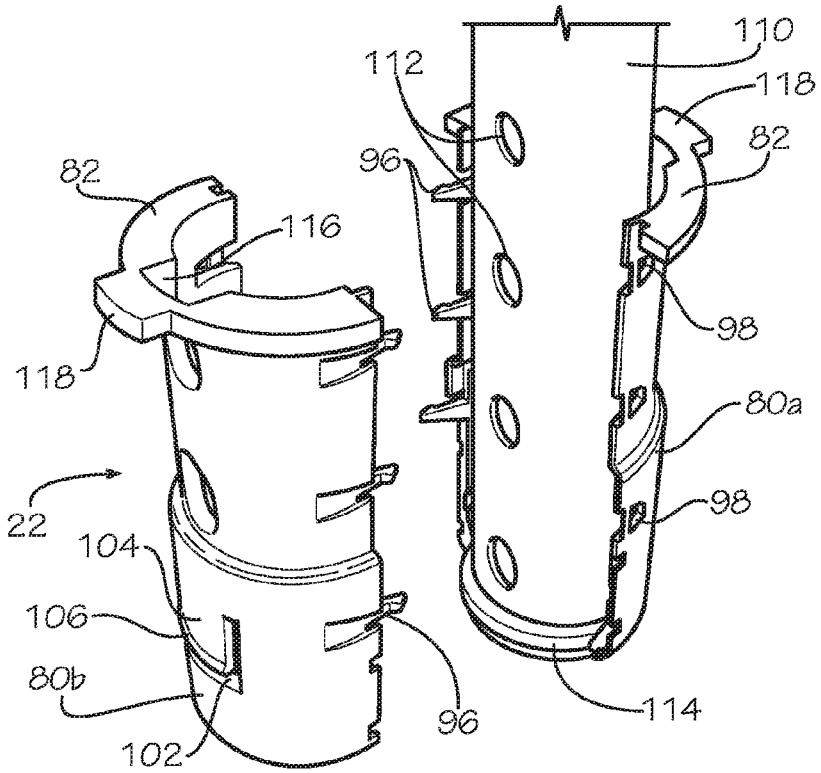
FIG. 2 illustrates in perspective exploded view the sleeve of the guide device illustrated in FIG. 1 during installation on a leg of an ambulatory assist device.

The second portion 86 defines in the side wall a U-shaped slot 102, to provide a flexibly bendable flag 104 in the side wall. A nub 106 projects outwardly from an outside surface of the flag 104, as shown in FIG. 2. During installation of the glide member 26 into the guide device 20, the groove 37 of the glide member 26 receives the nub 106 to mechanically connect the glide member to the sleeve 22.

FIG. 2 illustrates in perspective exploded view the sleeve 22 of the guide device 20 illustrated in FIG. 1 during installation on a leg 110 of an ambulatory assist device. The leg 110 typically is a cylindrical metal tubing and conventionally includes a plurality of spaced-apart openings 112 aligned longitudinally. A spring-biased pin conventionally selectively occupies one of the openings 112 for setting the length of the leg 110 relative to the telescoping tubes that define the leg. A distal end of the leg 110 receives a cap 114, such as a mushroom cap typically included on ambulatory assist devices. Often, the cap 114 includes an annular flange or projecting portion about a bottom portion of the cap. Alternatively, the sleeve 22 attaches to a leg without the cap 114 such as a cane, walker, or other ambulatory assist device.

As discussed above, the sleeve 20 in the illustrated embodiment comprises the matingly engageable shells 80*a*, 80*b*. The shells 80 are depicted in FIG. 2 in an "open" configuration during installation and for mechanically engaging together positioned over a lower end of the leg 110 of an ambulatory assistance equipment (e.g. walker peg leg). The shell 80*a* receives the leg 110 with the cap 114 within the second portion 88. The flange of the cap 114, if existent, occupies the groove 82. The shell 80*b* then engages the shell 80*b*. The fingers 96 of one shell 80 align with the slots 98 of the opposing shell. The installer then pushes the shells 80 together sandwiching the leg 110 and mechanically engaging the respective fingers and slots to engage the shells 80*a*, 80*b* together as the sleeve 22 on the lower portion of the leg 110, as illustrated in perspective view in FIG. 3.

Figure 2A:
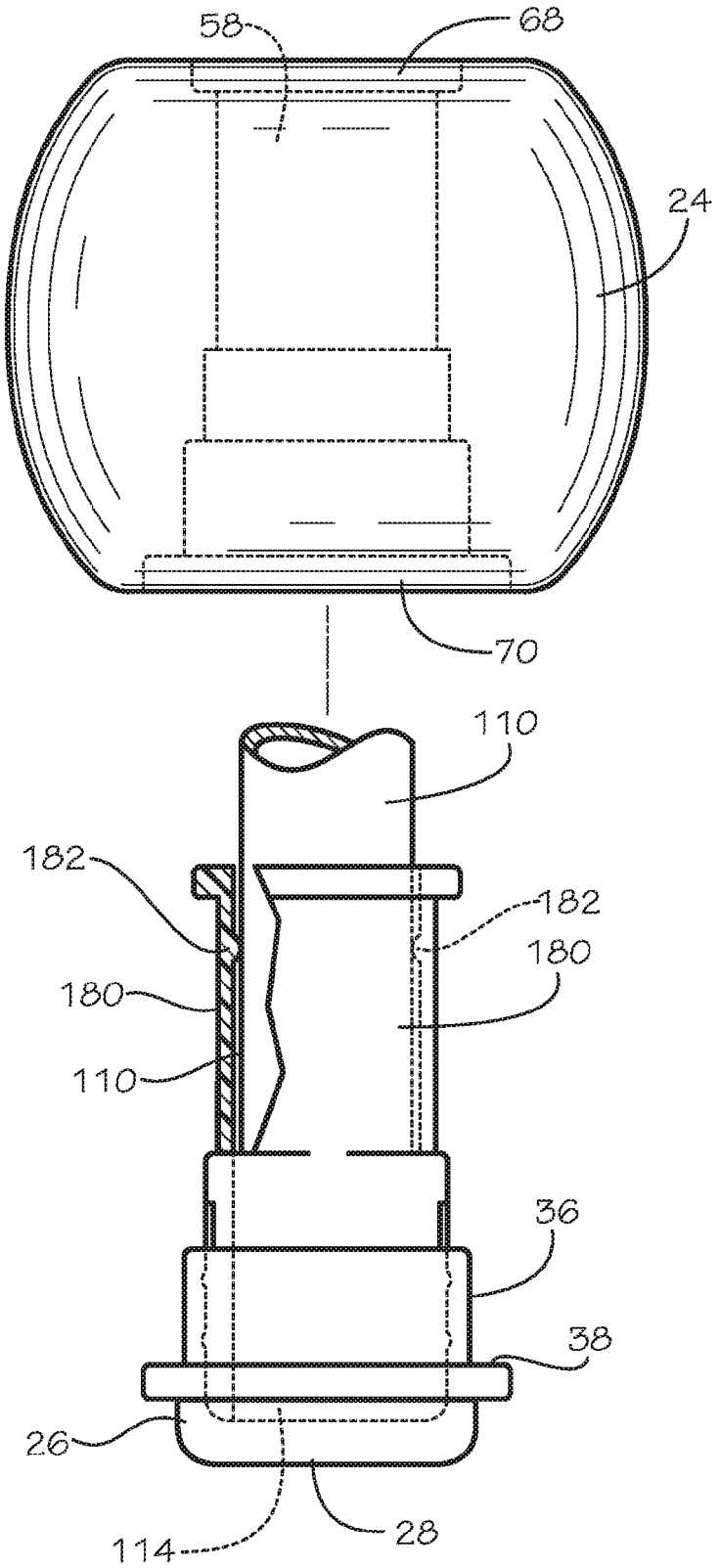
FIG. 2A illustrates an alternate embodiment of the sleeve of the guide device as a unitary tubular member.

In an alternate embodiment illustrated in partially cutaway, side elevational view in FIG. 2A, the sleeve 22 comprises a unitary tubular member 180 slidingly received on the leg 110. The glide member 26 positions over the lower end of the sleeve 180 and the body 24 is depicted exploded away in alignment, awaiting sliding engagement over the peg leg 110 and sleeve 180, in accordance with the instant disclosure. The member 180 in the illustrated embodiment defines inwardly projecting ridges or spaced-apart nubs 182 that bear against the wall of the leg 110. In an alternate embodiment, one of the nubs 182 engages one of the height-adjusting openings in the leg 110. In an alternate embodiment, a pin extends through an opening in the tubular member 180 for securing as the sleeve to the leg 110, for subsequent receiving of the body 24.

It is noted in reference to FIG. 2, that the shells 80 in certain embodiments include a notch 116 in the flange 82, which notch 116 aligns with an opening 112 in the leg 110 through which the pin member of the leg may be received depending on positioning of the pin in a selected one of the leg openings for setting the length of the leg 110 for use of the ambulatory assist device by a user. Also illustrated in FIG. 2, the flange 82 includes a protruding tab 118, which tab is received in a notched portion of the recess 68 of the body 24. The tab 118 assists with restricting rotation of the body 24 relative to the leg 110.

Figure 3:
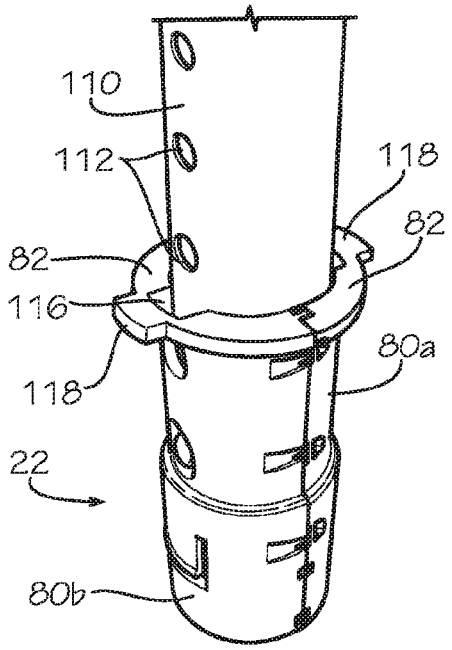
FIG. 3 illustrates in perspective view the sleeve of the guide device attached to the leg of the ambulatory assist device.

FIG. 3 illustrates a plan side view of a multi-component (i.e. two piece) boot leg or sleeve 22 component of the ambulatory assistance device 20, showing the sleeve 22 in a "closed" configuration around the walker peg leg 110. The sleeve 80*b* is configured with height adjustment holes 100 to accommodate the height adjustment component in the walker/ambulatory equipment. Further, in the "closed" configuration the sleeves 80*a*, 80*b* fit around the walker peg leg 110, wherein the mechanical engagement portion on the first piece or sleeve 80*a* is illustrated in the mechanically engaged/attached position with the mechanical engagement portion of the second piece or sleeve 80*b*.

Figure 4A:
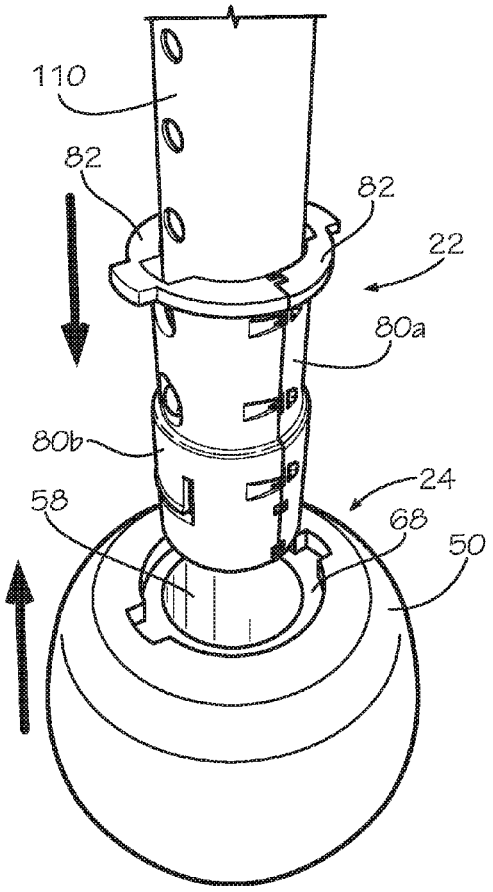
FIG. 4A-FIG. 4C illustrate in sequential perspective view the positioning of a resilient body on the sleeve of the guide device illustrated in FIG. 1 on the leg of the ambulatory assist device.
Figure 4B:
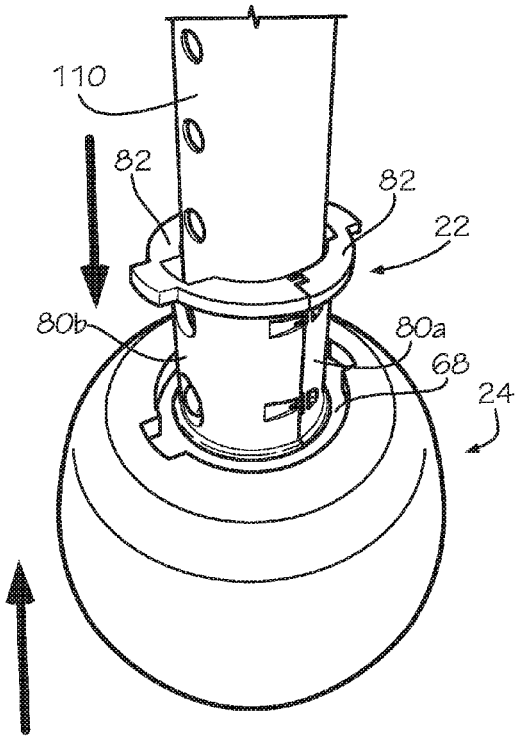
Figure 4C:
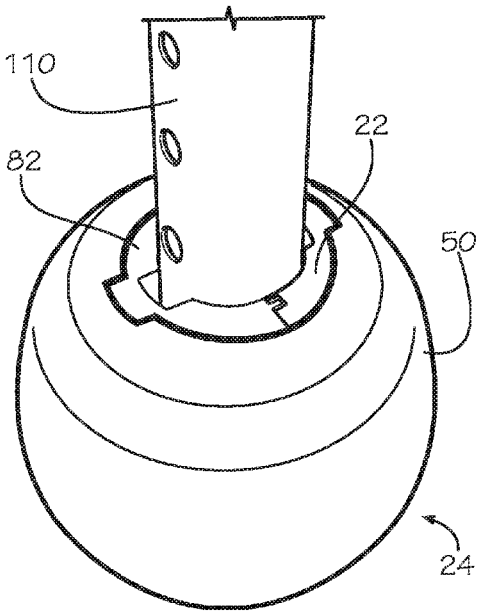

FIG. 4A-FIG. 4C illustrate in sequential perspective view the positioning of the resilient body 24 on the sleeve 22 of the guide device 20 on the leg 110 of the ambulatory assist device. FIG. 4A illustrates the sleeve 22 positioned on the leg 110 of the ambulatory assist device. The passageway 58 of the resilient body 24 aligns with the sleeve 22 with the upper planar surface 54 facing the sleeve. The installer moves the resilient body 24 relative to the sleeve 22, such as pushing the resilient body towards the sleeve or moving the leg 110 to push the sleeve into the passageway. The sleeve 22 enters the passageway 58 and with continued movement (FIG. 4B) moves longitudinally through the passageway until the flange 82 seats in the recess 68. As the flange 82 seats in the recess, a distal end of the sleeve passes into the portion of the passageway 58. There is a gap between the wall of the passageway and the wall of the sleeve 22. The exterior surface 52 of the body 24 defines a dimensional extent beyond a plane defined by an exterior surface of the leg 110, for a contacting and guiding surface as the ambulatory assist device is used by person while walking, for example, past obstructions such as walls and furniture.

Figure 5:
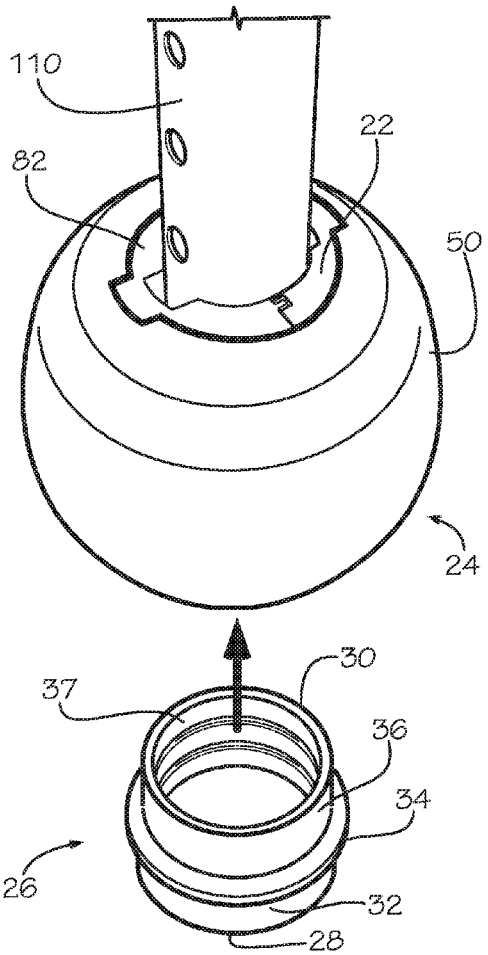
FIG. 5 illustrates positioning of a guide member to the sleeve and the resilient body of the guide device illustrated in FIG. 1 on the leg of the ambulatory assist device.

With reference to FIG. 5, the guide member 26 seats in the lower portion of the resilient body 24 by insertion through the open end of the lower planar surface 56. The wall 36 of the guide member 26 extends into the gap between the wall of the passageway 58 and the wall of the sleeve 22. The sleeve 22 thereby passes into the well 37 to the bottom 26. The upper edge of the wall 36 contacts the second transition 66 and the flange 34 seats in the recess 70. During installation of the glide member 26, the groove 37 receives the nub 106 projecting from the outside wall of the sleeve 22 to mechanically connect the glide member 26 to the sleeve 22 and resist the glide from coming off during use. The insertion of the nub 106 into the groove 37 provides a "clicked-in" feedback.

Figure 6:
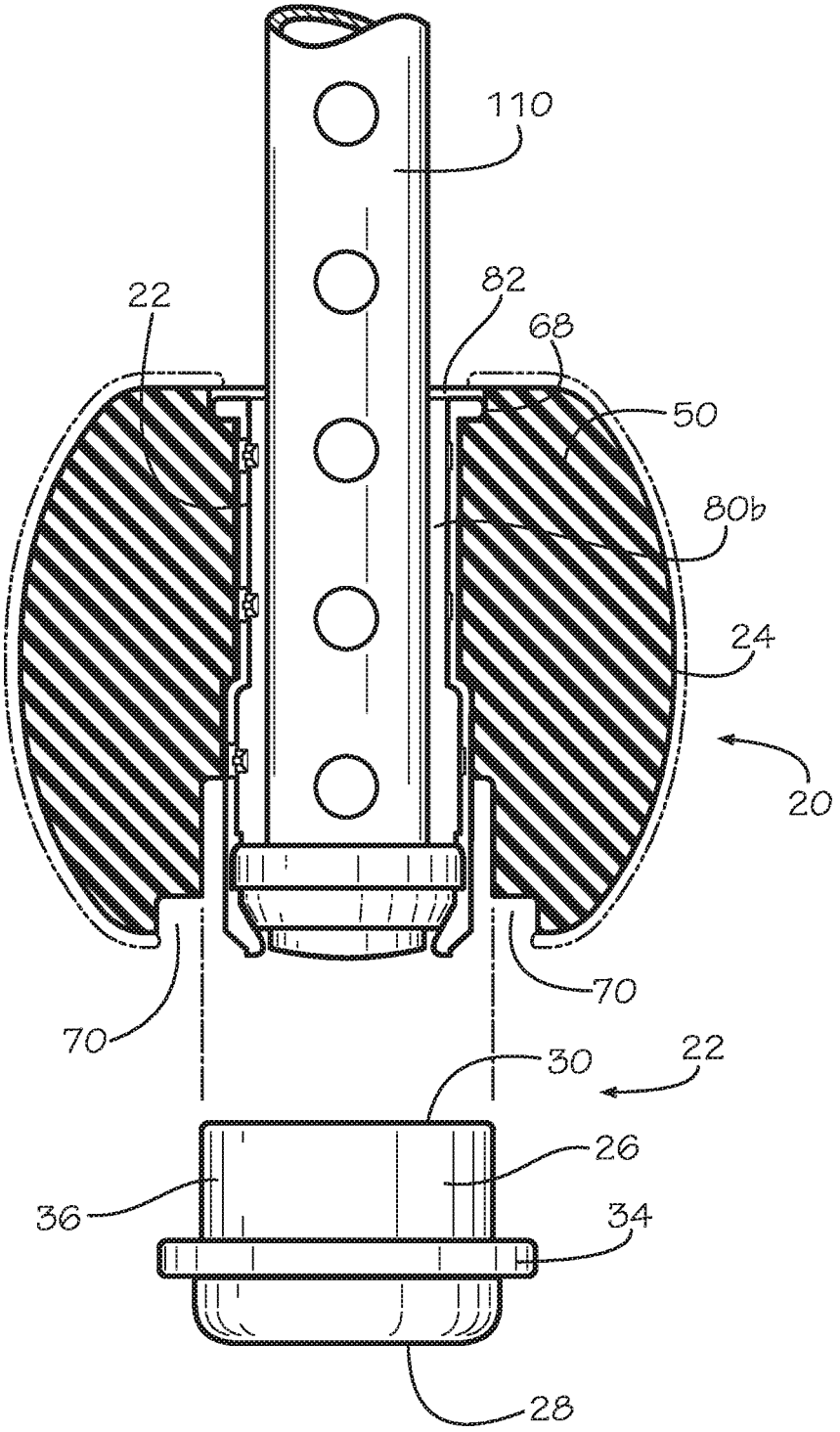
FIG. 6 illustrates in cross-sectional elevational view a first side of the guide device illustrated in FIG. 1 engaged to a leg of an ambulatory assist device.

FIG. 6 illustrates in cross-sectional side elevational view of the guide device 20 engaged to the leg 110 of the ambulatory assist device with the guide member 26 exploded away in preparation for positioning the guide member in the passageway 58 as discussed above in reference to FIG. 5.

With reference to FIGS. 1 and 5, the guide device 20 engaged to the leg 110 provides the resilient body 24 in the illustrated embodiment on the lower portion of the leg. The resilient body 24 provides a contactable surface that is distal from the leg 110. The contact surface provides a bumper or cushioning for guiding the movement of a person using the ambulatory assist device equipped with the guide device 24. During walking movements, the user may walk close to a wall or furniture. The surface 52 provides the dimensional extent of the resilient body 24 and contacts obstructions such as a wall or furniture surface first rather than the leg 110 contacting or hitting the wall or furniture, and thereby assists or guides the user away from or along the obstructions. Also, the glide surface 28 slidably moves along a floor surface as the user walks with the aid of the ambulatory assist device.

Figure 7:
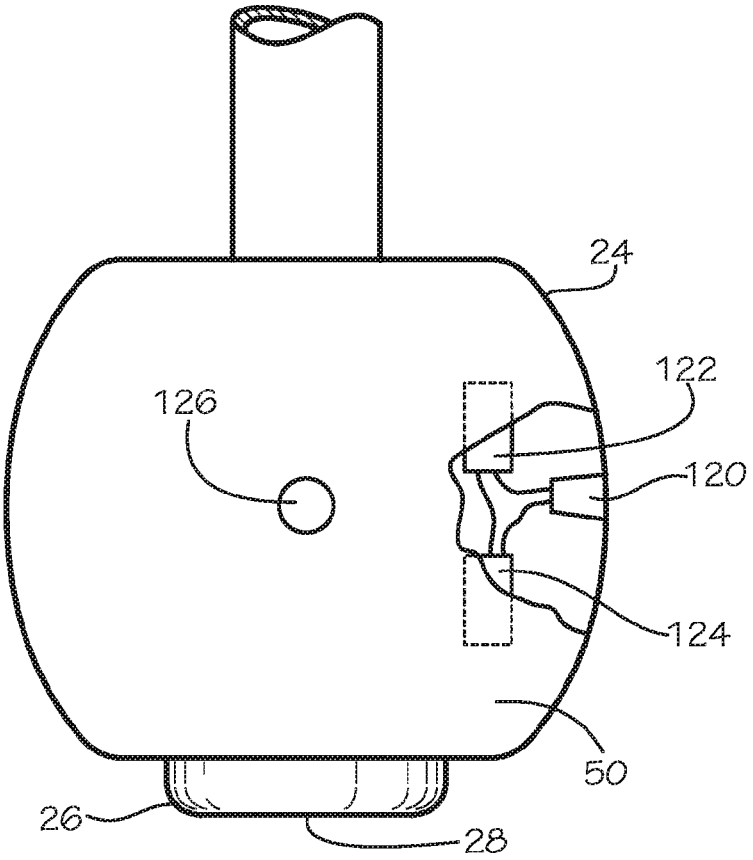
FIG. 7 illustrates in cross-sectional elevational view an alternate embodiment in which the guide device features a selectively operate light source for illuminating an area around the guide device during use of the ambulatory assist device in the dark.

FIG. 7 illustrates an alternate embodiment of the guide device 20 featuring a light source 120 mounted in the body 24 with a power supply 122 and a control mechanism 124 for selectively operating the light source 120. Light emitted from the light source 120 illuminates an area local thereto, for example, to illuminate in front of the guide device 20. In one embodiment, the light source 120 angles upward at an oblique angle, (e.g., at an angle of about 30 degrees with respect to a horizontal plane that intersects the glide surface 28) for optimum projection of light. The beam of light extends ahead of the guide device 20 to illuminate the forward and adjacent area so the user of the ambulatory assist device may more safely walk at night and/or in a dark environment. The light source 120 has two states (ON and OFF). In one embodiment, the light source 120 is manufactured by M.L.S. ELECTRONICS CO. (model number MCP12) and includes a light emitting diode (LED) (model number PK100), with an LED holder (model number PK101A) and an LED lens (model number PK102A). In one embodiment, the control mechanism 124 is manufactured by EASTAR INDUSTRIES LIMITED (model number MCP10) and includes the power supply 122 and control circuitry (model number ES33). In one embodiment, the light source 120, power supply 122 and control mechanism 124 are enclosed within the molded body 24; in an alternate embodiment, a cover (not illustrated) permits selective access thereto, for example, for replacing the power supply periodically. Electrical communication wires couple the electrical energy from the power supply 120 to the control mechanism 124 and the light source 120. In one embodiment, the power supply 120 is a lithium battery disposed in a battery holder. The guide device 20 further alternatively includes a switch for selective activation of the light source. The switch may be on/off slide, push button, or lever switch device for selective operation. Alternatively, the switch comprises a motion detection sensor, whereupon sensing motion, the control mechanism 124 communicates electrical current from the power supply 122 to the light source. The control mechanism 124 may be configured for supplying electrical current for a predetermined period subsequent to the signal from the motion detection sensor of detected motion. Thus, the light remains on for period if the user stops moving with the ambulatory assist device, such as standing without movement or becoming seated.

Alternatively, in another embodiment, the control circuitry of the control mechanism includes an integrated circuit (model number ES6115) and a capacitor (model number ES442) manufactured by EASTAR INDUSTRIES LIMITED. However, the control circuitry may include any suitable circuitry, such as an ASIC, a microprocessor, a circuit board, a battery, and the like. The control circuitry determines when to turn the light source 120 ON and OFF given the control signal from the motion sensor.

In a further embodiment, a light sensor 126 mounts in the body 24, to detect the amount of ambient light adjacent the guide device 20. In one embodiment, the light sensor 126 is manufactured by SEN TECH COMPANY LIMITED (BRAND: KRC) (model number KR16) and includes a Cadmium Sulfide (CdS) sensor (model number STC551), a sensor holder (model number WT1) and a sensor lens (model number WT2). The light sensor 126 outputs a signal indicative of the amount of ambient light sensed. The output of the light sensor 126 couples to control circuitry of the control mechanism 124. The control circuitry determines whether to turn the light source ON when the motion sensor detects motion of the ambulatory assist device equipped with the guide device 20 by comparing the signal indicative of the amount of ambient light sensed with a predetermined threshold. When the sensed light is above the threshold, the light source is disabled (whether the ambulatory assist device is in motion or not). When the sensed ambient light is below the threshold, the light source 120 is activated upon sensing motion. In this way, the battery life of the power supply is extended by not activating the light source 120 when the light is not needed, i.e., when there is sufficient ambient light adjacent the ambulatory assist device for use by the person for walking.

In a further embodiment, the control mechanism 124 includes a selector (not illustrated) for selecting a mode of operation, such as OFF, Auto ON and ON. The selector may include a switch, a thumb wheel, a dial, a plurality of buttons or other suitable means for selecting an operating mode. The OFF mode includes disabling the light source 120 such that no power is used. In this mode, the guide device 20 functions as normal, non-lighted guide for walking with the ambulatory assist device. The Auto ON mode includes enabling the motion sensor and the light sensor. In this mode, the guide device 20 functions as explained above for guiding the walking of the user, with the light source 120 activated only when there is motion of the ambulatory assist device equipped with the guide device 20 and the sensed ambient light is below the threshold level. The ON mode includes enabling the motion sensor such that the light source 120 goes ON anytime motion is detected. As noted above, the control mechanism 124 may maintain the light source 120 in the ON state for a period of time after motion stops.

Figure 8:
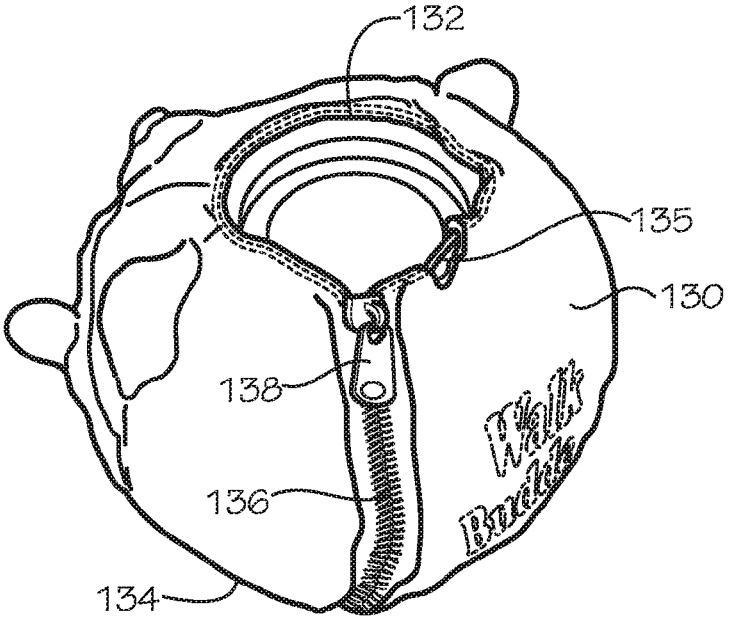
FIG. 8 illustrates in perspective view a cover for an enclosing ornamental wrap received on the guide device for customizing an appearance of the guide device.

FIG. 8 illustrates a wrap or cover 130 configured from a sheet of material, such as a fabric or other pliant flexible sheet, for an enclosing wrap received on the body 24. The cover 130 includes a first open end 132 and an opposing open end 134. The open end 132 is sized for passage of the leg 110 and the open end 134 is sized for exposing the glide surface 28 of the glide member 24 for gliding contact during use of the ambulatory assist device by person walking on a surface. The open ends 132, 134 may be configured with an elastic band 135 (shown in cut-away view) for partially closing the opening during use as a covering for the body 24. Further, a side opening 136 selectively opened and closed facilitates installation of the cover 130 onto the body 24. The side opening 136 may include closure devices such as a zipper 138, matingly engagable fabric members (such as opposing VELCRO patches), button and aligned button hole in the opposing edge portions, or the like. The sheet may include ornamental decorations, patterns, colors for selective customization of the appearance of the guide device 24 by the user. Although not illustrated, the cover 130 may alternatively include character indicia including eyes, nose and mouth, of a character, animal, fantasy character, or other such appearance.

Figure 9:
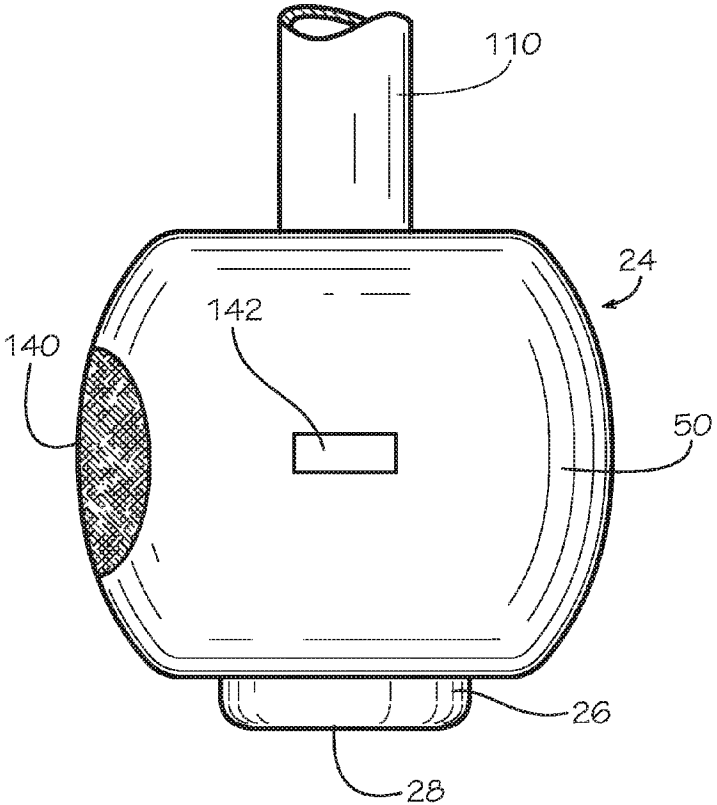
FIG. 9 illustrates an alternate embodiment in which the guide device 20 further includes a sound emitting speaker 140 operatively connected to a source means 142 of audio signals for being communicated as to sound.

FIG. 9 illustrates an alternate embodiment in which the guide device 20 further includes a sound emitting speaker 140 operatively connected to a source means 142 of audio signals for being communicated as to sound. In one embodiment, the source means 142 comprises an electronic device having a digital memory configured for storing audio signals and a controller for operating the electronic device for selective playback and emitting the sounds through the speaker 140. In an alternate embodiment, the source means 142 comprises an electronic signal/mechanical port that engages a wired cable that communicates with an exterior electronic device configured for storing and playback of electronic audio signals. For example, the electronic signal/mechanical port is a USB port selectively connected to a USB cable from a smart phone, tablet, or other microprocessor-based audio signal storage and playback device, each configured for selection and play of stored audio signals. In yet another embodiment, the source means comprises a network communications receiver, such as a BLU RAY signals receiver, for receiving audio signals and emitting such as sound through the speaker 140.

Figure 10:
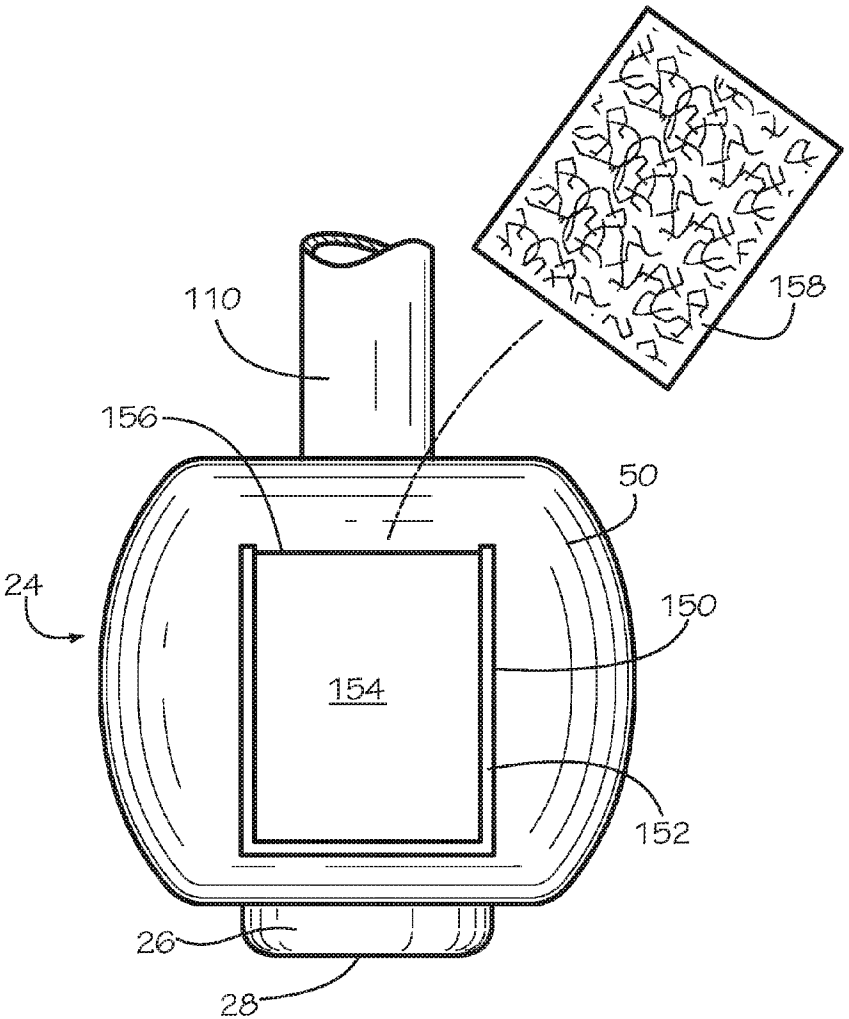
FIG. 10 illustrates an alternate embodiment of the guide device featuring a pocket for selective display of an ornamental sheet in accordance with the present invention.

FIG. 10 illustrates an alternate embodiment of the body 24 that includes a pocket 150. The pocket 150 attaches to the side wall or exterior surface 52 with closed side and bottom edges 152 and secures a transparent plate 154 to form a receiving space between the surface 52 and the transparent plate 154. A side 156 of the pocket 150 is open for selective access to the receiving space. The user selectively may insert an ornamental sheet 158 through the open side 156 into the receiving space for display of ornamentation through the transparent plate 154 and thereby customize the appearance of the guide device 20. The ornamental sheet 158 may be a graphic, text, photograph, or other ornamental indicia. For example, children may color a drawing for a relative needing to use an ambulatory assist device for walking. Such relative may thereby personalize the walker device. Alternatively, the pocket 150 readily attaches to the cover 130 discussed above.

It is to be appreciated that while the present disclosure details attaching the guide device 20 relative to the leg 110 of the ambulatory assist device, the guide device readily attaches to other frame members of ambulatory assist devices, including handle bars of roller devices, side frame members of wheel chairs, and cross-members at upper portions of conventional ambulatory assist devices such as walkers. In such application, the guide device 20 includes the sleeve 20, a liner or body 24, and alternatively the ornamental cover 130, but omits the glide member 26, as the assist device 20 is configured to circumferentially attach to frame portion of an ambulatory assist device. For example, the guide device 20 is received on and extends over a portion of the frame tubing of an ambulatory assist device, wherein the frame tubing of the ambulatory assist device (e.g. a portion of a four-wheeled walker, wheel chair, or the like) extends from the opposing upper and lower ends of the guide device 20. In this configuration, the peg leg of the assistive device passes through the sleeve 80 (e.g., the sleeve shells 80*a*, 80*b* simply snap around any portion of the ambulatory assist device's lower, mid or higher frame). The liner 24 and cover 130 are designed to slip over the sleeve 80. In this embodiment, in order to accommodate the diameter changes of the various peg legs or frame poles from a standard walker, to a cane, to a rollator walker, etc., brackets commonly available for use on ambulatory assist equipment may be utilized in conjunction with the guide device 20. Alternatively, compression components (e.g., a strip of compression foam configured with an adhesive on either one or both sides) may be disposed between the guide device 20 and the frame tube of the walker/wheel chair/ambulatory assist device, such that the compression component is wrapped around at least one desired portion or section of the frame of the ambulatory assist device, so as to adjust and/or replace any space deficit (i.e., in order to promote and/or provide a snug and secure fit between the guide device 20 and the frame of the ambulatory assist device).

Figure 11:
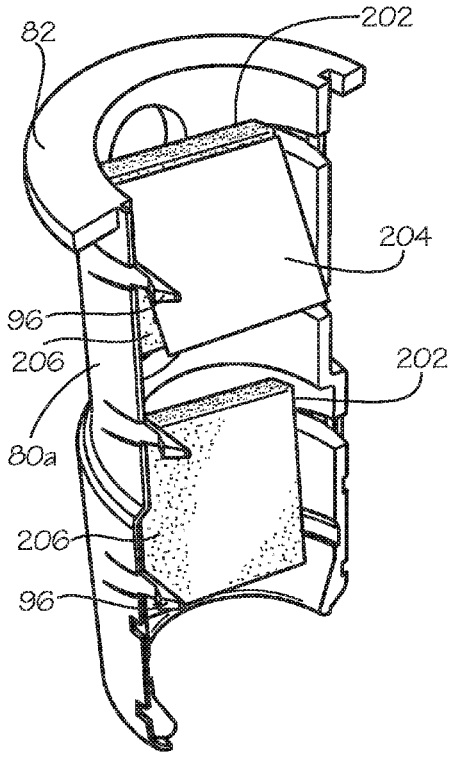
FIG. 11 illustrates an alternate embodiment of the guide device featuring an attachment member for securing the guide device to an ambulatory assist device.
Figure 12:
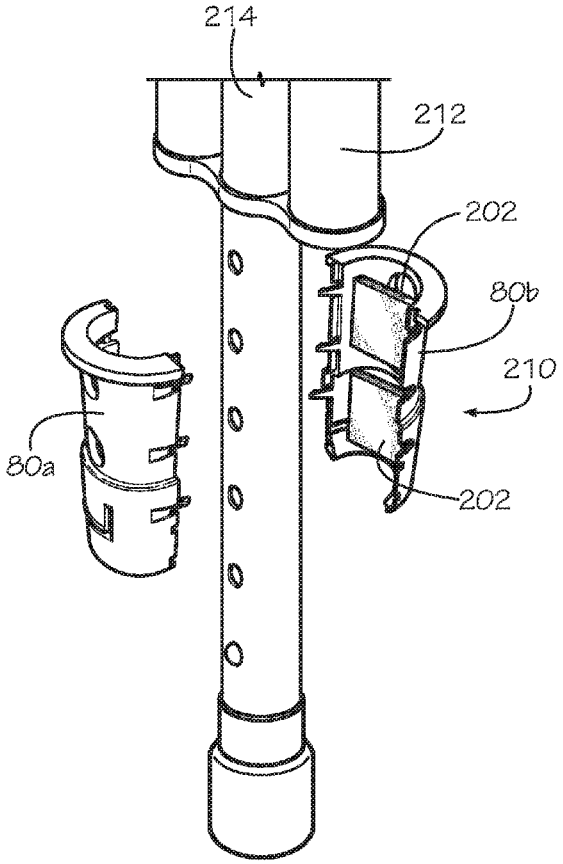
FIG. 12 illustrates the guide device attaching to a leg of a crutch.
Figure 13:
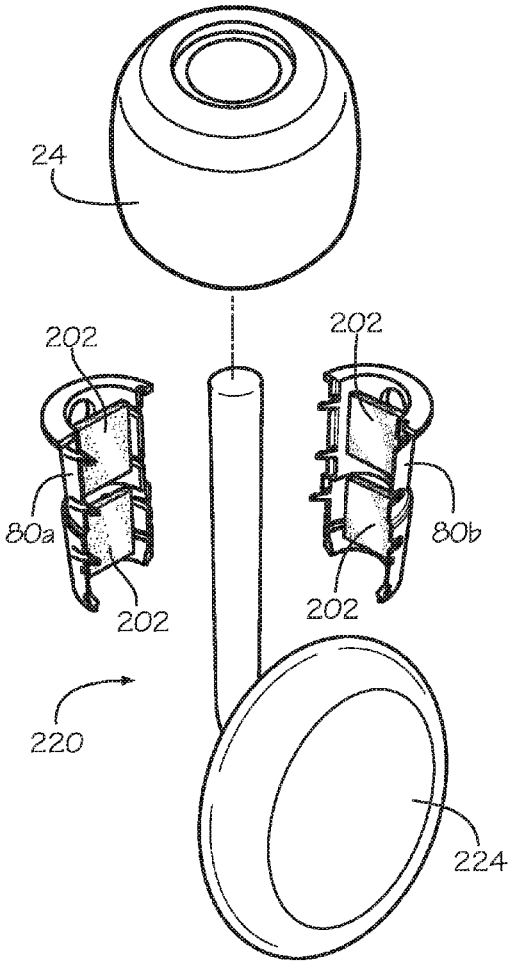
FIG. 13 illustrates the guide device attaching to a leg of a wheeled walker ambulatory assist device.

More particularly described, FIG. 11 illustrates an alternate embodiment of the guide device 20 featuring an attachment member 202 disposed within the shell 80*a* for securing the guide device to an ambulatory assist device. The attachment member 202 is a resilient foam member having opposing surfaces with an adhesive 206 closed by a detachable cover sheet 204. The shell 80*a* is illustrated with two of the attachment members. The cover sheet 204 is detached from a first one of the adhesive surfaces 206 and the attachment member 202 attached thereby to the inner surface of the shell 80*a*. The cover sheet 204 of the other adhesive surface is detached for securing the shell 80*a* to the leg 110, such as remote from the distal end as illustrated in FIG. 12 for attaching the guide device 24 to a leg of tubular crutch 210 having opposing supports 212 attached to a central leg member 214. The central leg member 214 receives the leg 110 for positioning at a selected height for the person using the crutch as an ambulatory assist device. The resilient body 24 (not illustrated) attaches to sleeve 22 as discussed above. It is to be appreciated that the body 24 may have an ornamental exterior or alternatively receive the ornamental cover 130 discussed above. The adhesive surface 206 of the attachment members 202 secures the shells 80*a*, 80*b* to the leg 110 remote from the distal end.

Similarly, the guide device 24 readily attaches to a walker ambulatory assist device having a wheel assembly 220 with a leg stem 222 received in a leg thereof and a wheel 224 conventionally attached for rotation during walking use. The shells 80*a*, 80*b* of the sleeve attach with the adhesive attachment members 202 to the leg stem 222. The guide body 24 slidingly moves onto the leg stem 222 and the sleeve 22, as discussed above.

Figure 14:
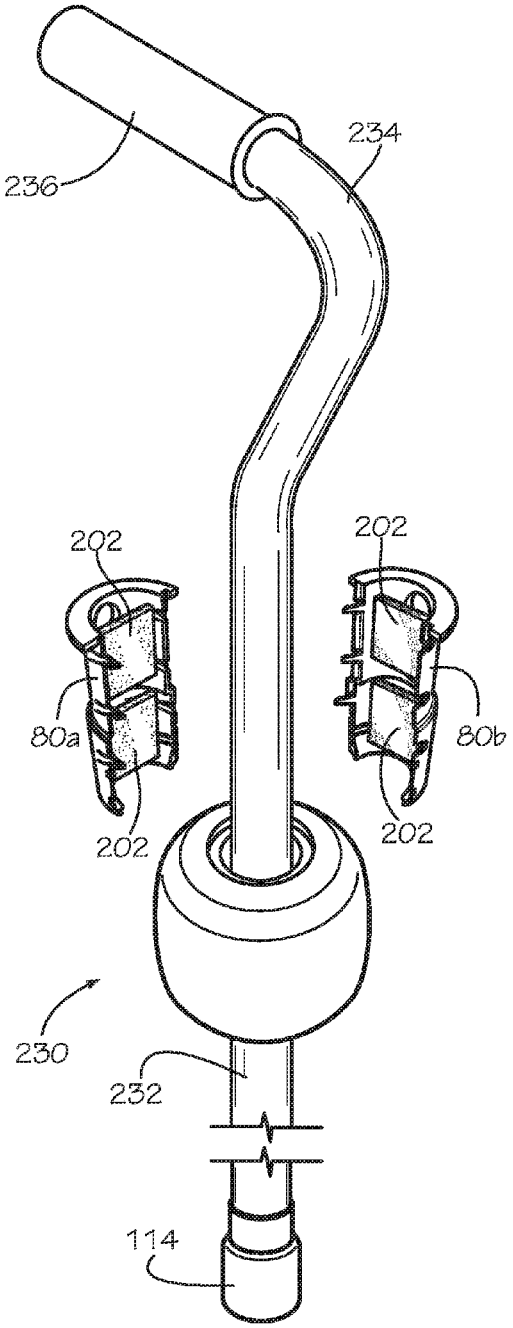
FIG. 14 illustrates the guide device attaching to a cane intermediate a handle and a distal end.

FIG. 14 illustrates the guide device 20 attaching to a cane 230 intermediate a handle 234 with a grip 236 at an upper end and a distal end that may include as illustrated the tip 114. The sleeve 22 engages the intermediate portion of a cane member 232. In the illustrated embodiment, the sleeve 22 comprises the opposing shells 80*a*, 80*b* that attach to a selected portion of the cane member 232. The adhesive member 202 secures the shells to the cane member. In this embodiment, the mechanical engagements of the fingers 96 and slots 98 supplement the connecting of the shells to the cane member.

Figure 15A:
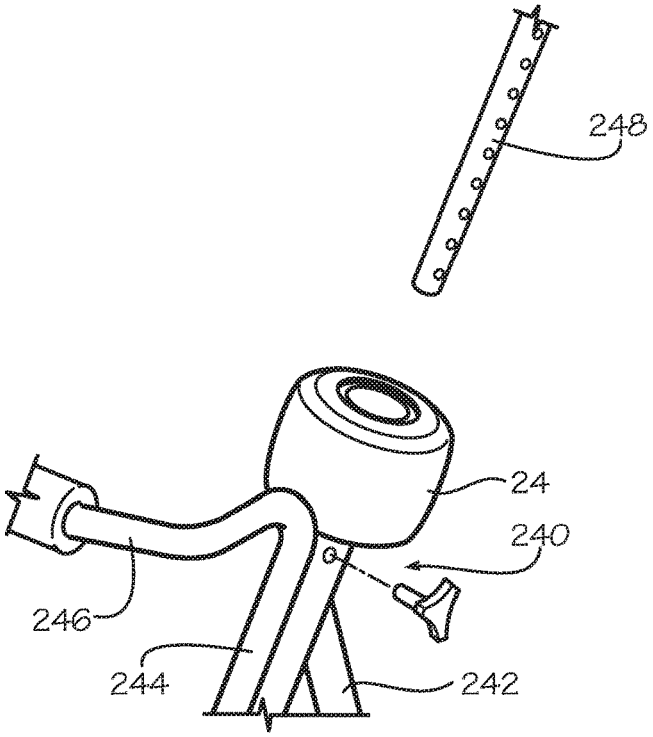
FIGS. 15A and 15 B illustrate the guide device attaching for ornamental purposes to a handle of a ambulatory assist stroller.
Figure 15B:
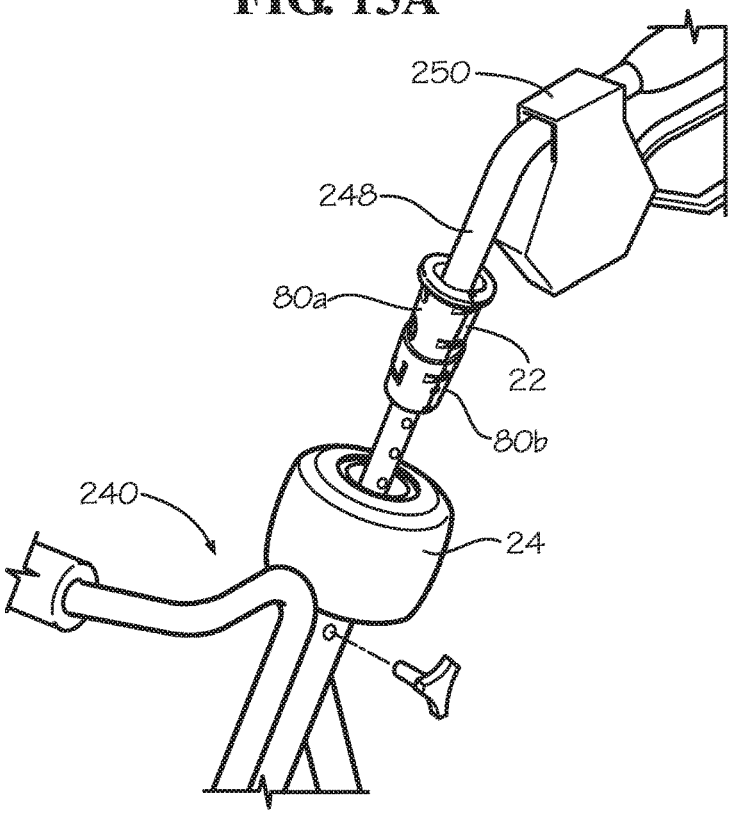

FIGS. 15A and 15B illustrate the guide device 20 attaching for ornamental purposes to a handle portion of an ambulatory assist stroller 240 having opposing rear legs 242, opposing front legs 244, and a transverse support 226. Each of the front legs 144 receives a respective handle arm 248. The handle arm 248 defines spaced-apart openings for selectively adjusting the height of a handle 250 for the stroller 240 conventionally with a spring-biased pin that extends through a selected one of the openings. The handle 248 detaches from the leg 244 and a stem portion of the leg 244 receives the guide body 24. The handle 248 then reinserts into the leg 244 and may be selectively positioned using the height-adjustment openings and pin. The shells 80*a*, 80*b* having the adhesive patch members 202 attach to a selected portion of the handle 248. The resilient body 24 is pushed into sliding reception with the sleeve 22.

While various embodiments of the present invention have been described in detail, it is apparent that modifications and adaptations of those embodiments will readily occur to those skilled in the art. However, it is to be expressly understood that such modifications and adaptations are within the spirit and scope of the present invention as set forth in the appended claims.

What is claimed is:

1. A guide for an ambulatory assist device, comprising:

a sleeve comprising a first shell and a second shell for disposing on a leg of an ambulatory assist device;

means for detachably engaging the first shell and the second shell together about the leg of the ambulatory assist device;

a body having a through passageway defining opposing open ends, the passageway disposed on a first axis of the body for enclosingly receiving the sleeve in the passageway, the body having an exterior surface that defines a dimensional extent beyond a plane defined by an exterior surface of the leg; and a glide member having a continuous side wall for defining a chamber that is open at one end and closed by a bottom surface at an opposing end, wherein the chamber in the glide member receives a lower portion of the sleeve with the side wall received into the passageway of the body, whereby the dimensional extent of the body defines a contact surface for guiding a user while walking with the ambulatory assist device past obstructions to passage.

2. The guide as recited in claim 1, wherein the means for detachably engaging comprises first attaching means with a first attaching characteristic and second attaching means with a second attaching characteristic, the first and second characteristics for matingly engaging the first attaching means of one of the shells with the second attaching means of the other of the shells, for matingly attaching the first and second shells together on the leg of the ambulatory assist device.

3. The guide as recited in claim 1, wherein:

the first shell and the second shell each have a first side edge and a second side edge; and means for engaging comprises:

at least a pair of fingers disposed in spaced apart relation on the first edge; and at least a pair of slots defined in a portion of the second edge in alignment with the fingers, whereby the first shell and the second shell detachably engage by engaging the fingers of one shell with the slots of the other shell.

4. The guide as recited in claim 3, wherein the fingers each have a stop extending laterally from distal end portion; and wherein the slots each have a detent member, each of the detent members contacted by a respective one of the stops when the first shell and the second shell detachably engage.

5. The guide as recited in claim 1, further comprising a pair of resilient members, each disposed inwardly of a respective one of the shells for bearing against the leg.

6. The guide as recited in claim 5, wherein the resilient members having adhesive surfaces on opposing sides for adhesively attaching to an inner surface of the respective shell and adhesively attaching to the leg.

7. The guide as recited in claim 1, wherein the guide member further comprising a flange extending laterally of the side wall intermediate the open end and the bottom surface, with a surface of the flange and the exterior surface of the side wall defining a seat for a portion of the body.

8. The guide as recited in claim 7, wherein the body defines in a first one of the open ends a recessed ledge, the flange for being received on the recessed ledge.

9. The guide as recited in claim 1, wherein the sleeve defines a first portion and a second portion, the first portion having a first cross-sectional area and the second portion having a second cross-sectional area different from the first cross-sectional area.

10. The guide as recited in claim 9, wherein the sleeve defines a cylindrical passageway in which the first portion has a first diameter and the second portion has a second diameter.

11. The guide as recited in claim 10, wherein the chamber is sized for receiving a distal end of the second portion of the sleeve.

12. The guide as recited in claim 9, wherein the passageway in the body has a first section that receives the first portion of the sleeve and a second section that receives the second portion of the sleeve.

13. The guide as recited in claim 1, further comprising an ornamental feature on the exterior surface of the body.

14. The guide as recited in claim 1, further comprising a cover having an ornamental feature, the cover selectively detachably attached to the body.

15. The guide as recited in claim 14, wherein the cover comprises a sheet configured for enclosing the body and defining a first opening for passage of the leg therethrough and an opposing second opening for exposing the glide surface for gliding contact during use of the ambulatory assist device by person walking on a surface.

16. The guide as recited in claim 1, wherein the body further comprises a pocket having closed edges with a transparent cover between the closed edges thereof and an open edge, whereby an ornamental sheet may be positioned through the open edge in the pocket.

17. The guide as recited in claim 16, wherein the ornamental sheet comprises a photograph.

18. The guide as recited in claim 16, wherein the ornamental sheet depicts a seasonal character.

19. A method of facilitating guidance of an ambulatory assist device, comprising the steps of:

(a) disposing a sleeve on a leg of an ambulatory assist device, comprising the steps of:

(i) positioning a longitudinally extended first shell onto the leg of the ambulatory assist device; and (ii) attaching a longitudinally extended second shell onto the leg of the ambulatory assist device, the first and second shells having respective first attaching means and second attaching means, the first attaching means having a first characteristic and the second attaching means having a second characteristic, the first and second characteristics for matingly engaging the first attaching means of one of the shells with the second attaching means of the other of the shells, for matingly attaching the first and second shells together on the leg of the ambulatory assist device;

(b) positioning a body on the sleeve, the body having a through passageway defining opposing open ends for enclosingly receiving the sleeve in the passageway, the body having an exterior surface that defines a dimensional extent beyond a plane defined by an exterior surface of the leg; and (c) closing a lower end of the through passageway with a glide member having a continuous side wall that defines a well open at a first end for receiving a portion of the sleeve upon inserting the glide member into the passageway and closed at an opposing end with a bottom glide surface for contacting a surface during use by a person walking with aid of the ambulatory assist device, whereby the dimensional extent of the body defines a contact surface for guiding the user walking past obstructions to passage.

20. The method as recited in claim 19, wherein the step (a) disposing further comprises the step of matingly engaging a first attaching means of one of the shells with a second attaching means of the other of the shells, the first attaching means having a first characteristic and the second attaching means having a second characteristic, for matingly attaching the first and second shells together on the leg of the ambulatory assist device.

21. The method as recited in claim 20, wherein:

the first shell and the second shell each have a respective first side edge and a second side edge; and first attaching means comprises at least a pair of fingers disposed in spaced apart relation on the first edge and extending laterally therefrom; and second attaching means comprises at least a respective pair of slots defined in a portion of the second edge in alignment with the pair of fingers, whereby the first shell and the second shell detachably engage by engaging the fingers of one of the first and second shells with the slots of the other shell.

22. The method as recited in claim 21, wherein the fingers each have a stop extending laterally from distal end portion; and wherein the slots each have a detent member, each of the detent members contacted by a respective one of the stops when the first shell and the second shell attachingly engage.

23. The method as recited in claim 19, further comprising the step of disposing a pair of resilient members, each inwardly of a respective one of the shells for bearing against the leg.

24. The method as recited in claim 23, further comprising the step of providing an adhesive surface on opposing sides of the resilient members for adhesively attaching the resilient members to an inner surface of the respective shell and adhesively attaching to the leg.

25. The method as recited in claim 19, further comprising the step of providing the body with an ornamental feature.

26. The method as recited in claim 25, wherein the step of providing the ornamental feature comprises providing the exterior surface of the body with the ornamental feature.

27. The method as recited in claim 25, wherein the step of providing the ornamental feature comprises enclosing the body within a cover having the ornamental feature.

28. The method as recited in claim 27, where the step of enclosing comprises opening the cover, positioning the cover about the body, and closing the cover, the cover defining a first opening for passage of the leg therethrough and an opposing second opening for exposing the glide surface for gliding contact during use of the ambulatory assist device by person walking on a surface.

29. The method as recited in claim 19, further comprising the step of attaching a pocket to the body having closed edges with a transparent cover between the closed edges thereof and an open edge; and inserting an ornamental sheet through the open edge of the pocket.

30. The method as recited in claim 29, further comprising the step of providing a photograph as the ornamental sheet for insertion into the pocket.

31. The method as recited in claim 29, further comprising the step of providing the ornamental sheet with a depiction of a seasonal character.

32. A guide for an ambulatory assist device, comprising:

a sleeve having a first portion and a second portion for disposing on a leg of an ambulatory assist device, the first portion having a first cross-sectional area and the second portion having a second cross-sectional area different from the first cross-sectional area;

a body having a through passageway defining opposing open ends, the passageway disposed on a first axis of the body and having a first section that receives the first portion of the sleeve and a second section that receives the second portion of the sleeve for enclosingly receiving the sleeve in the passageway, the body having an exterior surface that defines a dimensional extent beyond a plane defined by an exterior surface of the leg; and a glide member having a continuous side wall for defining a chamber that is open at one end and closed by a bottom surface at an opposing end, wherein the chamber in the glide member receives a lower portion of the sleeve with the side wall received into the passageway of the body, whereby the dimensional extent of the body defines a contact surface for guiding a user while walking with the ambulatory assist device past obstructions to passage.

33. A guide for an ambulatory assist device, comprising:

a sleeve for disposing on a leg of an ambulatory assist device;

a body having a through passageway defining opposing open ends, the passageway disposed on a first axis of the body for enclosingly receiving the sleeve in the passageway, the body having an exterior surface that defines a dimensional extent beyond a plane defined by an exterior surface of the leg;

an ornamental feature on the exterior surface of the body; and a glide member having a continuous side wall for defining a chamber that is open at one end and closed by a bottom surface at an opposing end, wherein the chamber in the glide member receives a lower portion of the sleeve with the side wall received into the passageway of the body, whereby the dimensional extent of the body defines a contact surface for guiding a user while walking with the ambulatory assist device past obstructions to passage.

34. A guide for an ambulatory assist device, comprising:

a sleeve for disposing on a leg of an ambulatory assist device;

a body having a through passageway defining opposing open ends, the passageway disposed on a first axis of the body for enclosingly receiving the sleeve in the passageway, the body having an exterior surface that defines a dimensional extent beyond a plane defined by an exterior surface of the leg;

a cover having an ornamental feature, the cover selectively detachably attached to the body; and a glide member having a continuous side wall for defining a chamber that is open at one end and closed by a bottom surface at an opposing end, wherein the chamber in the glide member receives a lower portion of the sleeve with the side wall received into the passageway of the body, whereby the dimensional extent of the body defines a contact surface for guiding a user while walking with the ambulatory assist device past obstructions to passage.

35. The guide as recited in claim 34, wherein the cover comprises a sheet configured for enclosing the body and defining a first opening for passage of the leg therethrough and an opposing second opening for exposing the glide surface for gliding contact during use of the ambulatory assist device by person walking on a surface.

36. A guide for an ambulatory assist device, comprising:

a sleeve for disposing on a leg of an ambulatory assist device;

a body having a through passageway defining opposing open ends, the passageway disposed on a first axis of the body for enclosingly receiving the sleeve in the passageway, the body having an exterior surface that defines a dimensional extent beyond a plane defined by an exterior surface of the leg;

the body having a pocket defined by closed edges and an open edge, the pocket having a transparent cover disposed between the closed edges thereof, whereby an ornamental sheet may be positioned through the open edge in the pocket; and a glide member having a continuous side wall for defining a chamber that is open at one end and closed by a bottom surface at an opposing end, wherein the chamber in the glide member receives a lower portion of the sleeve with the side wall received into the passageway of the body, whereby the dimensional extent of the body defines a contact surface for guiding a user while walking with the ambulatory assist device past obstructions to passage.

37. The guide as recited in claim 36, wherein the ornamental sheet comprises a photograph.

38. The guide as recited in claim 36, wherein the ornamental sheet depicts a seasonal character.

* * * * *